US008251352B2

(12) United States Patent
Chiorazzi et al.

(10) Patent No.: US 8,251,352 B2
(45) Date of Patent: Aug. 28, 2012

(54) VENTURI APPARATUS FOR POURING AND AEREATING BEVERAGES

(76) Inventors: Frank Chiorazzi, Salinas, CA (US); F. David LaRiviere, Monterey, CA (US)

( * ) Notice: Subject to any disclaimer, the term of this patent is extended or adjusted under 35 U.S.C. 154(b) by 0 days.

(21) Appl. No.: 12/877,718

(22) Filed: Sep. 8, 2010

(65) Prior Publication Data

US 2012/0056339 A1 Mar. 8, 2012

(51) Int. Cl.
*B01F 3/04* (2006.01)

(52) U.S. Cl. ..... 261/76; 261/DIG. 75; 222/190

(58) Field of Classification Search ..... 261/76, 261/77, DIG. 75; 222/190
See application file for complete search history.

(56) References Cited

U.S. PATENT DOCUMENTS

| | | | | |
|---|---|---|---|---|
| 2,241,337 | A * | 5/1941 | Work | 261/77 |
| 2,497,134 | A * | 2/1950 | Muenze | 222/481 |
| 3,750,915 | A * | 8/1973 | Kearney | 222/567 |
| 3,822,217 | A | 7/1974 | Rogers | |
| 4,224,158 | A | 9/1980 | Molvar | |
| 4,308,138 | A | 12/1981 | Woltman | |
| 4,337,152 | A * | 6/1982 | Lynch | 210/197 |
| 4,522,151 | A | 6/1985 | Arbisi et al. | |
| 5,298,198 | A | 3/1994 | LaCrosse | |
| 5,370,069 | A | 12/1994 | Monroe | |
| 5,496,505 | A * | 3/1996 | Walla et al. | 261/76 |
| 5,514,267 | A | 5/1996 | Machiya et al. | |
| 5,645,223 | A * | 7/1997 | Hull et al. | 239/428.5 |
| 5,799,836 | A * | 9/1998 | Lee | 222/189.07 |
| 6,230,944 | B1 * | 5/2001 | Castellano et al. | 222/481.5 |
| 6,279,598 | B1 | 8/2001 | Boticki et al. | |
| 6,293,294 | B1 | 9/2001 | Loeb et al. | |
| 6,395,175 | B1 | 5/2002 | Gao et al. | |
| 6,568,660 | B1 | 5/2003 | Flanbaum | |
| 6,767,006 | B1 * | 7/2004 | Tripepi | 261/23.1 |
| 7,156,377 | B2 | 1/2007 | Chapman et al. | |
| 7,299,743 | B2 | 11/2007 | Moore | |
| D614,443 | S | 4/2010 | Federigni | |
| D624,358 | S * | 9/2010 | Maufette et al. | D7/398 |
| 2004/0036185 | A1 | 2/2004 | Garcia | |
| 2004/0113288 | A1 | 6/2004 | Korzeniowski | |
| 2007/0187848 | A1 | 8/2007 | Sabadicci et al. | |
| 2007/0196249 | A1 | 8/2007 | Fridman et al. | |
| 2007/0256568 | A1 | 11/2007 | Nudi et al. | |
| 2009/0160072 | A1 * | 6/2009 | Chiorazzi | 261/76 |
| 2011/0024925 | A1 * | 2/2011 | Mauffette | 261/76 |

OTHER PUBLICATIONS

Web page; Wine Accessories, Corkpops, The fastest and easiest way to open a bottle of wine; VinOair Wine Aerator www.corkpops.com/Merchant2/merchant.mvc?Screen=PROD&Product_Code=009 . . . , Dec. 2010.

* cited by examiner

*Primary Examiner* — Charles Bushey
(74) *Attorney, Agent, or Firm* — LaRiviere, Grubman & Payne, LLP

(57) ABSTRACT

An improved venturi apparatus for the incorporation of air into a liquid. The preferred embodiment of the invention comprises an entry section, a cylindrical section, and an outflow section. Lateral tubes extend from the cylindrical section so as to form an acute angle relative to both the central and cross-sectional axes of the cylindrical section, thereby preventing leakage of liquid out through the lateral tubes during use and subsequent handling. The entry section includes a breather tube connected to the cylindrical section.

3 Claims, 8 Drawing Sheets

VENTURI APPARATUS FOR POURING AND AEREATING BEVERAGES

CROSS-REFERENCE TO RELATED DOCUMENTS

This application is related to U.S. application Ser. No. 12/045,361, filed Mar. 10, 2008, now U.S. Pat. No. 7,992,844.

BACKGROUND OF THE INVENTION

The principles of a venturi apparatus are well known in the art. Fluid flowing in a tube that passes through a constricted region experiences both an increase in velocity and simultaneous drop in pressure. The placement of an opening along the area of constriction produces a suction effect due to the decreased pressure of the fluid flowing in that portion of the tube. This principle has been exploited for numerous applications, including flow measurement and the introduction of additional fluids into an existing stream.

As recognized in the prior art, a simple venturi apparatus may be employed to facilitate aeration of a liquid such as wine. One such prior art design consists of a vertically oriented venturi device having a first funnel section connected to a cylindrical section that is in turn connected to a second funnel-type frusto-conical section. Two sidearm passageways extend horizontally from the cylindrical section. Liquid poured into the first funnel section is channeled into the cylindrical section, where it increases in velocity and decreases in pressure. This creates a suction effect that draws in air through the sidearm passageways. The air is thus incorporated into the liquid, which exits the device through the second funnel-type frusto-conical section. (See U.S. Patent Application Publication No. US2007/0187848A1 ('848)).

Another prior art design also utilizes the venturi principle for simultaneously pouring liquid for a container and mixing air into the liquid. Thus, the pourer of U.S. Pat. No. 6,568,660 B1 may be used for simultaneously pouring wine from a bottle and decanting the wine.

However, problems exist in both prior art designs. Notably, the devices are prone to leaking liquid out through air passageways. This is especially likely to occur when a large amount of liquid is poured through the devices. In order to minimize the likelihood of leakage, a user must maintain the device described in the '848 publication in a near perfect vertical orientation during usage, and in a carefully determined angle from vertical in the case of the pourer of the '660 patent. And even so, this may not ensure that leakage does not occur, especially when larger quantities of liquid are poured.

The prior art device is thus unpredictably prone to leakage of liquid, which can cause many additional problems for the user. A leaked beverage, particularly as with red wine, can result in stains that are difficult to clean. Such leakage also renders the device itself slippery and difficult to handle, in addition to soiling the user's hand. Moreover, beverages such as fine wine can be quite expensive, and any loss due to leakage constitutes a cost that must be borne by the user.

The '848 prior art device is also prone to formation of a vortex in the liquid. Vortical flow causes the liquid to flow along the walls of the cylindrical section and thereby tends to block the movement of air into the liquid. This blockage thereby reduces the efficiency with which the device can aerate a liquid. In the '660 prior art device, only one air passageway is provided at an inefficiently designed constriction for producing the venturi effect. The result is a very slow pouring device and poor aereation.

SUMMARY OF THE INVENTION

The present invention is directed to an improved venturi apparatus for simultaneously pouring and aereating a liquid, such as wine, from a container, that addresses the aforementioned deficiencies in the prior art. In an embodiment of the present invention, the apparatus comprises a conduit through which a first fluid flows, having a constricted intermediate region. One or more lateral tubes for introducing a second fluid at the constricted intermediate region are formed at a substantially acute angle relative to the direction of flow of the first fluid through the constricted intermediate region. The placement of lateral angles of the lateral tubes is selected to maximize flow of the first liquid from the container without overflowing through them.

In a first preferred embodiment of the invention, the apparatus comprises an entry or inlet section formed to fit into the opening of the container that is fluidly connected to a cylindrical section, which in turn is fluidly connected to an outflow section. A planar segment is disposed upstream of the cylindrical section to inhibit vortical flow. Two diametrically opposed lateral tubes extend from the cylindrical section at substantially acute angles relative to the central and orthogonal axes of the cylindrical section, and are fluidly continuous with the exterior. The lateral tubes facilitate the introduction of air into liquid flowing in the device, and their angled orientation prevents leakage of liquid through the tubes.

In a second preferred embodiment, the apparatus of the present invention includes all of the elements of the first preferred embodiment with two modifications to improve fluid flow through the conduit. According to the second embodiment, the portion of the entry that fits into the mouth or opening of the bottle is extended to provide infrastructure for a ventilation or breather tube. In addition, an optional outlet cover is provided for food service applications.

BEST MODES FOR CARRYING OUT THE INVENTION

Figure 1:
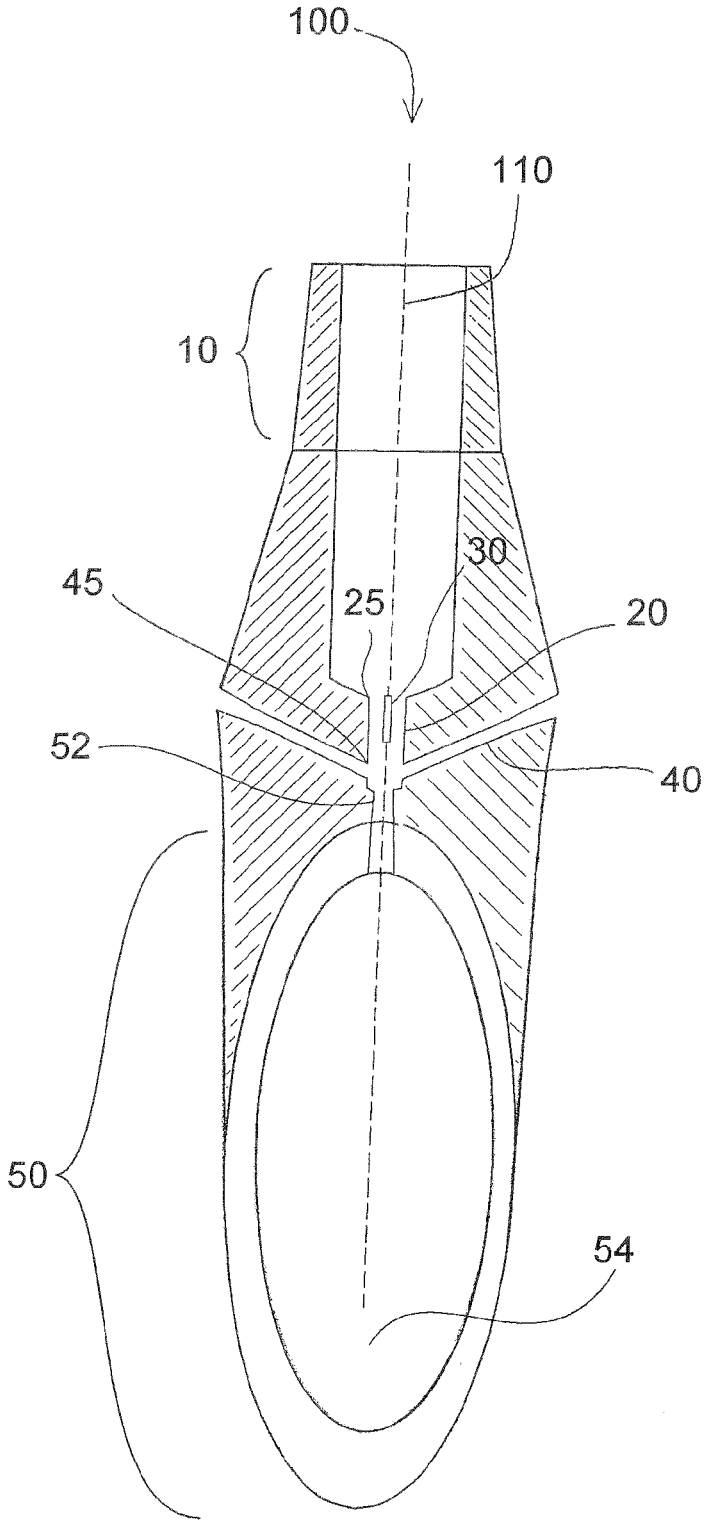
FIG. 1 is a top view cross section of a first embodiment of the present invention.
Figure 2:
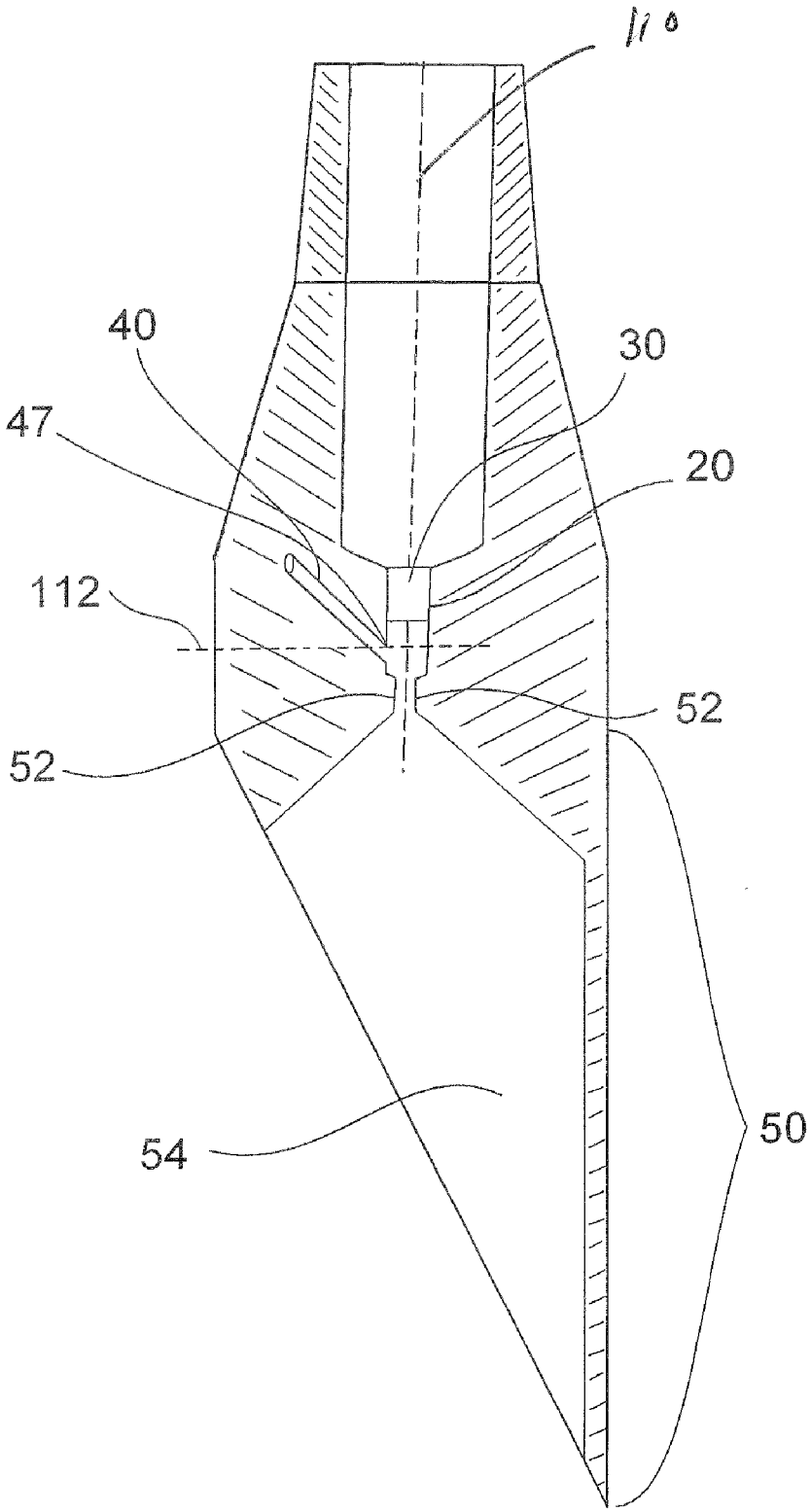
FIG. 2 is a side view cross section of the embodiment of FIG. 1.
Figure 3:
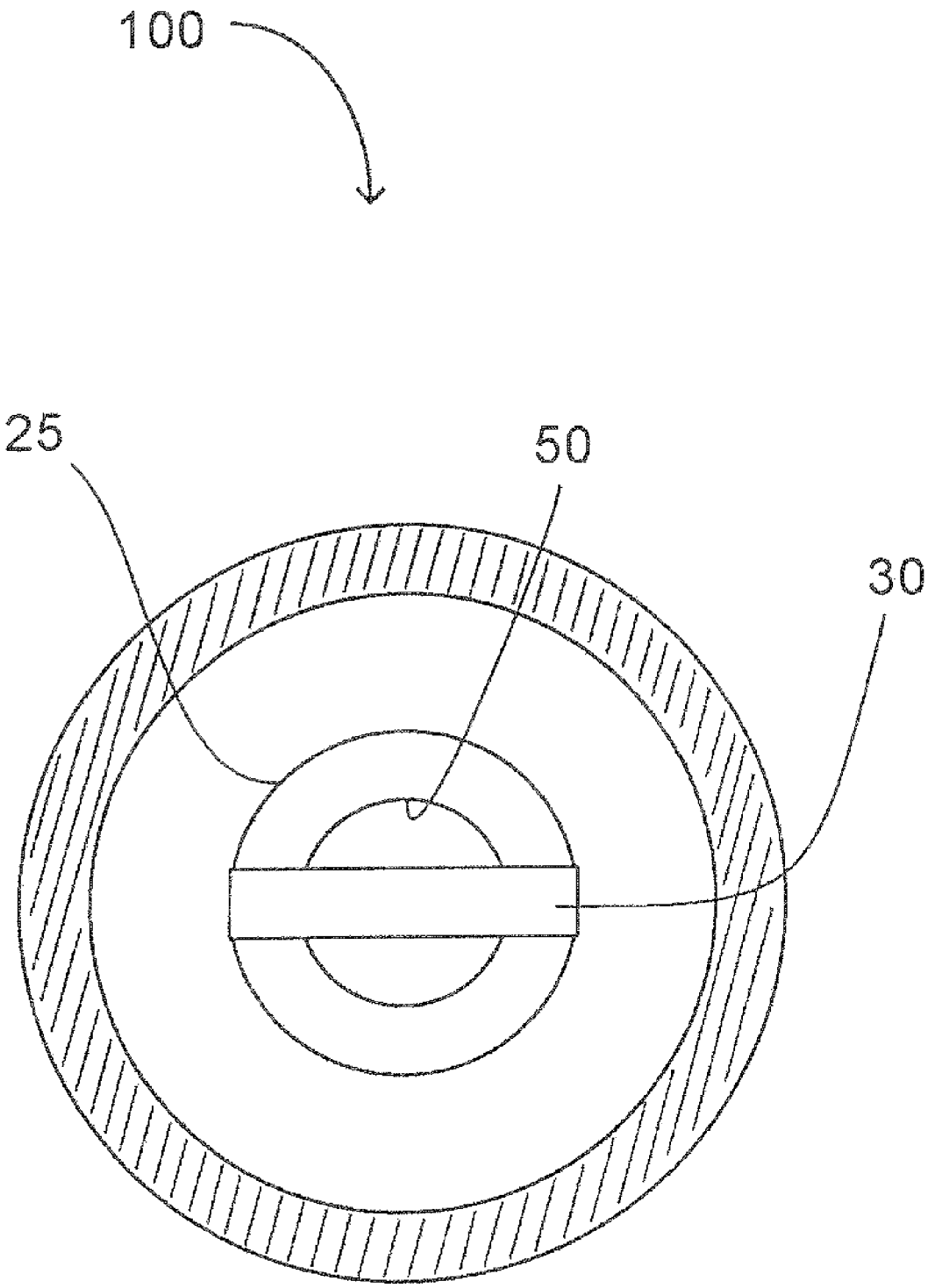
FIG. 3 is an end view of the entry section of the embodiment of FIG. 1.

The present invention is drawn to an improved venturi apparatus for mixing two fluids. In an embodiment of the present invention, apparatus 10 comprises a conduit through which a first fluid flows, the conduit having a constricted intermediate region. One or more lateral tubes for introducing a second fluid at the constricted intermediate region are formed at a substantially acute angle relative to the direction of flow of the first fluid through the constricted intermediate region. The constricted intermediate region has a further constriction at its downstream end, this being found to enhance mixing of the fluids.

A planar segment is coupled to the intermediate region to inhibit vortical flow, where the plane of the segment is disposed in the direction of flow of the first liquid. A reduction in vortical flow improves the efficiency of the device because vortical flow causes fluid to adhere to the walls of the device, and thereby inhibits introduction and mixing of the second fluid.

The present invention is drawn to an improved vertically oriented venturi apparatus for facilitating the aeration of a liquid beverage such as wine. With reference to FIGS. 1-4, an embodiment 100 of the present invention is shown, having central axis 110 and vertical axis 111 and lateral axis 112.

Entry section 10 has an annular cross-section for conducting the flow of the liquid beverage to the constricted intermediate region, when pouring liquid through the device from a bottle. The inner diameter of entry section 10 is substantially uniform along the axis and direction of liquid flow. The outer diameter of section 10 is tapered to be adapted to fit into the top opening of a bottle, and may comprise or include a soft material for providing a seal between the bottle opening and pourer 100.

Cylindrical section 20 is fluidly connected at the other end to the narrow end of entry section 10, and centered about central axis 110. Cylindrical section 20 is preferably of substantially uniform diameter throughout its length. Rim 25 is formed by the intersection of the narrow end of funnel section 10 and the top of cylindrical section 20. Rim 25 of entry section 10 is preferably bowl-shaped or, substantially flat, so as to form a sharp, nearly perpendicular, angle with cylindrical section 20, preferably in the range of 90-120 degrees. This arrangement decreases the likelihood of vortex formation as the liquid enters cylindrical section 20.

Opposed lateral tubes 40 are fluidly connected to cylindrical section 20, extending from section 20 so as to form a substantially acute angle 45 degrees relative to the central axis 110 and the direction of fluid flow, and are fluidly continuous with the exterior of the device. As liquid is poured through the device, air is drawn into the liquid via the lateral tubes. The upward angled orientation of the lateral tubes prevents liquid from leaking out through the tubes, during both actual use and subsequent handling.

Vertically planar segment 30 is disposed up-stream from the intersection with lateral tubes 40, and bisects cylindrical section 20 to counteract any vortical flow in the liquid.

Outflow section 50 is fluidly connected at its entry end to the exit of cylindrical section 20. Outflow section 50 has a diameter at its entry end 52 that is smaller than that of cylindrical section 20, this being found to facilitate enhanced mixing of air with liquid prior to exiting the device. Exit end 54 of either section 50 may have any shape for efficiently and conveniently guiding the aereated liquid to another container, such as a wine glass. In addition, an optional outlet cover 138 is provided as usually required for food service applications.

In operation, liquid to be aerated is poured into entry section 10, and thereby channeled into cylindrical section 20. Any vortex motion is inhibited by vertical planar segment 30. This is important because vortical flow will cause the liquid to adhere to the sides of cylindrical section 20 and thereby tend to inhibit the introduction of air into the liquid. As the liquid passes through cylindrical section 20, air is drawn into the liquid through the lateral tubes 40. The aerated liquid exits the device through the outflow section 50.

Figure 4:
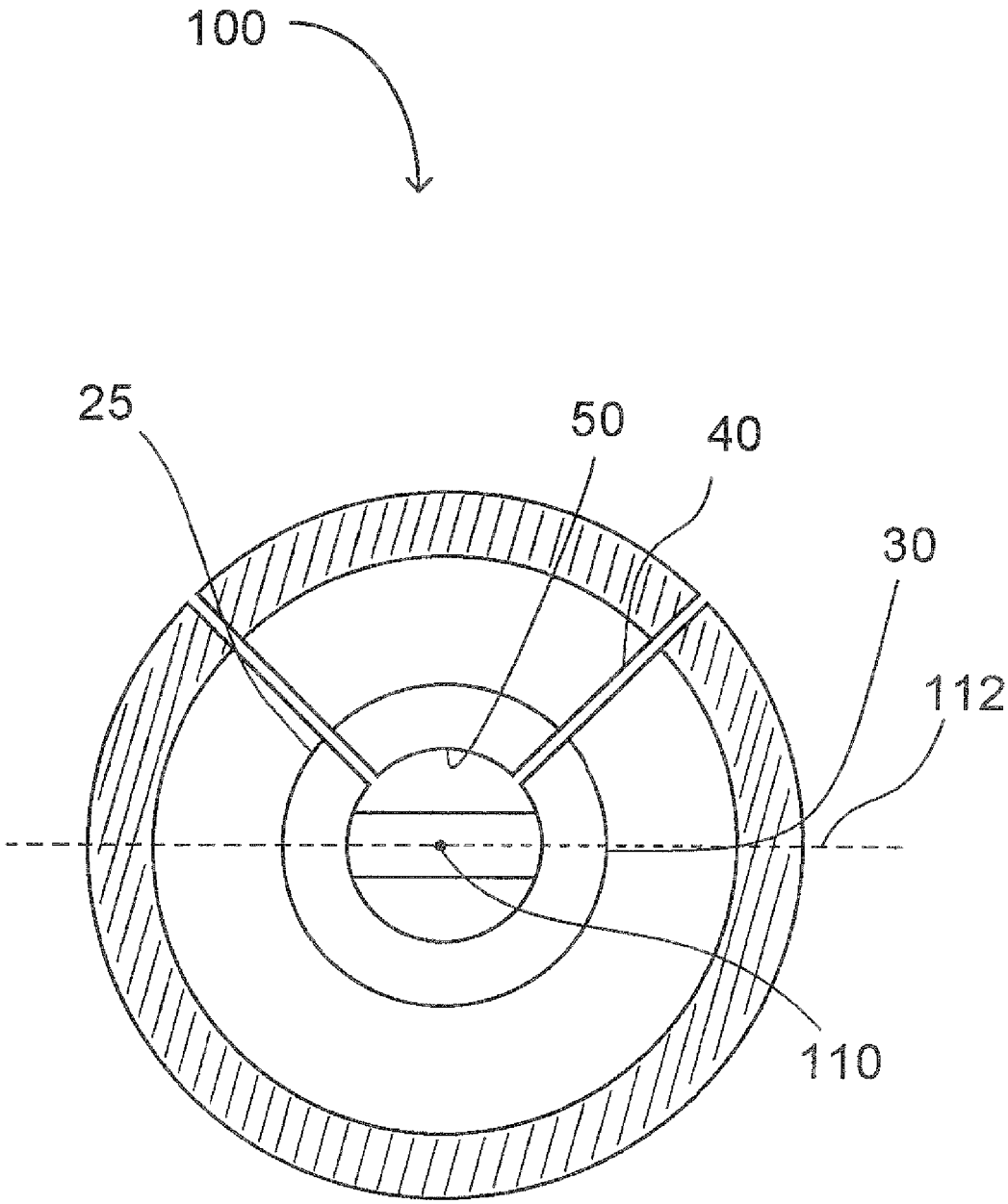
FIG. 4 is an end view from the outflow at the intersection of axes 110, 111 and 112 of the embodiment of FIG. 1.

Referring to FIG. 4, the orientation of lateral tubes 40 with respect to axes 110 and 112 is shown. Lateral tubes 40 should be set at approximately 45 degrees with respect to axis 112, and intersect cylindrical section 20 above axis 110 relating to the flow of liquid.

Figure 5:
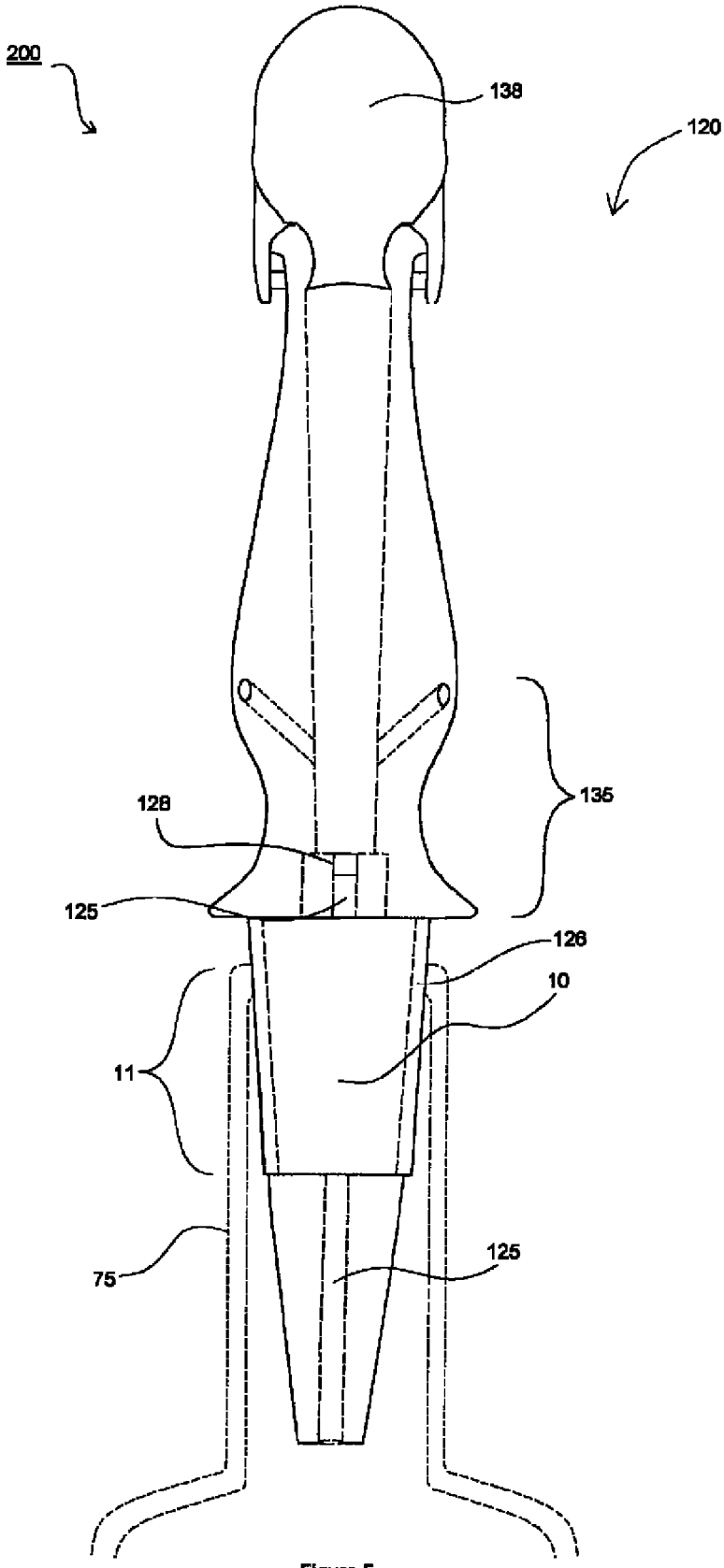
FIG. 5 is the top view of a second embodiment of the present invention.
Figure 6A:
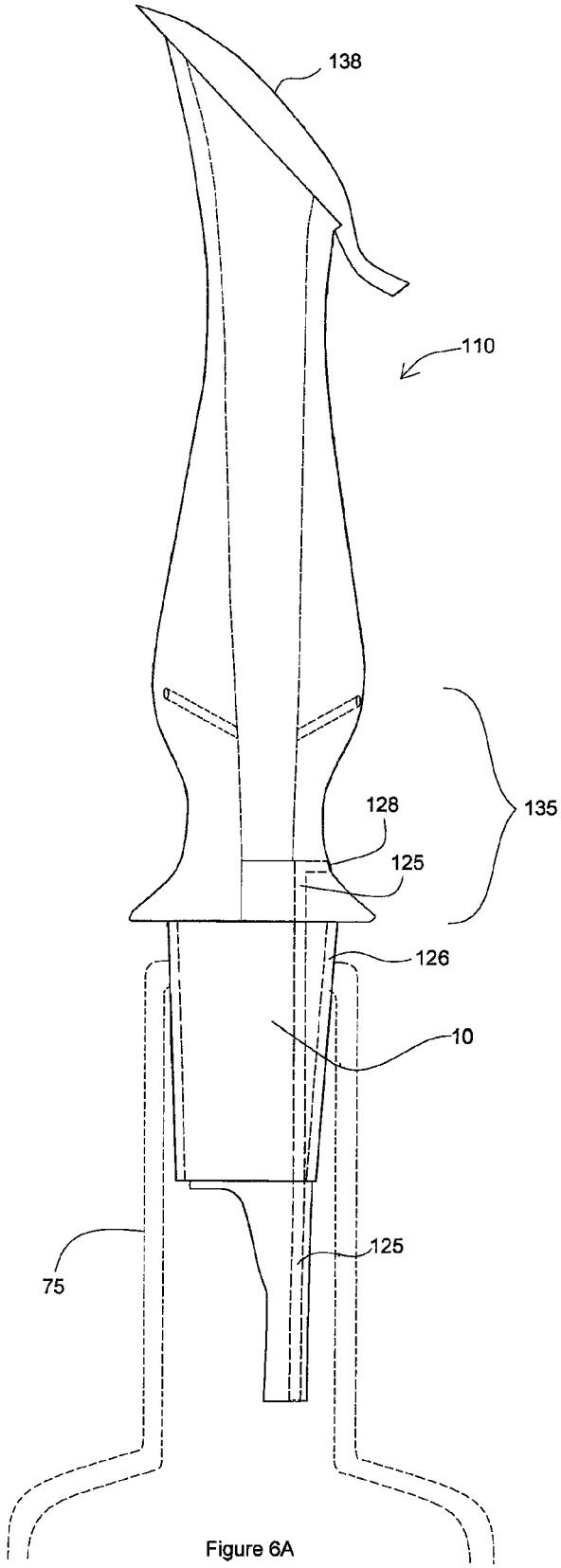
FIG. 6A is a side view of the embodiment of FIG. 5.

With reference to FIGS. 5 and 6A, pourer 200 is a second embodiment of pourer 100. In particular, section 135 includes all of the elements of pourer 100, and operates in the same or similar way, as described in paragraphs 0021 through 0027 hereof.

Ventilation or breather tube 125 is disposed along the top of entry section 10. Portion 11 of entry section 10 is extended into the neck of bottle 75 to provide infrastructure for ventilation tube 125, and includes liquid seal coating or sleeve 126 and air intake 128. Sleeve 126 can be made of any deformable elastomer material having a suitable durometer for forming a liquid seal with the inner surface of the bottle opening and which is safe for food service applications. Bottle 75 is presented here for illustrative purposes only and forms no part of the present invention.

Tube 125 may be formed to fit within entry section 10 as a separate structure, or in conjunction with coating 126. If formed with coating 126, tube 125 can be constructed as a channel with entry section 10 enclosed by the wine surface of coating 126.

Figure 6B:
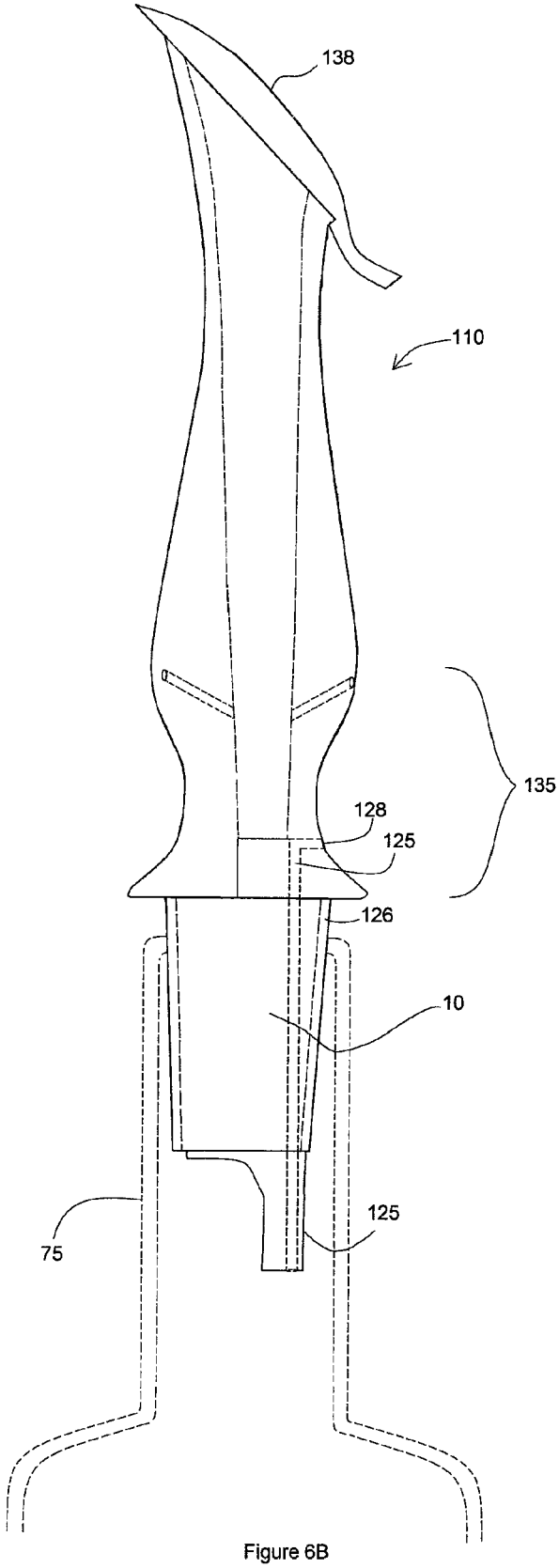
FIG. 6B is a side view of another embodiment of FIG. 5.
Figure 6C:
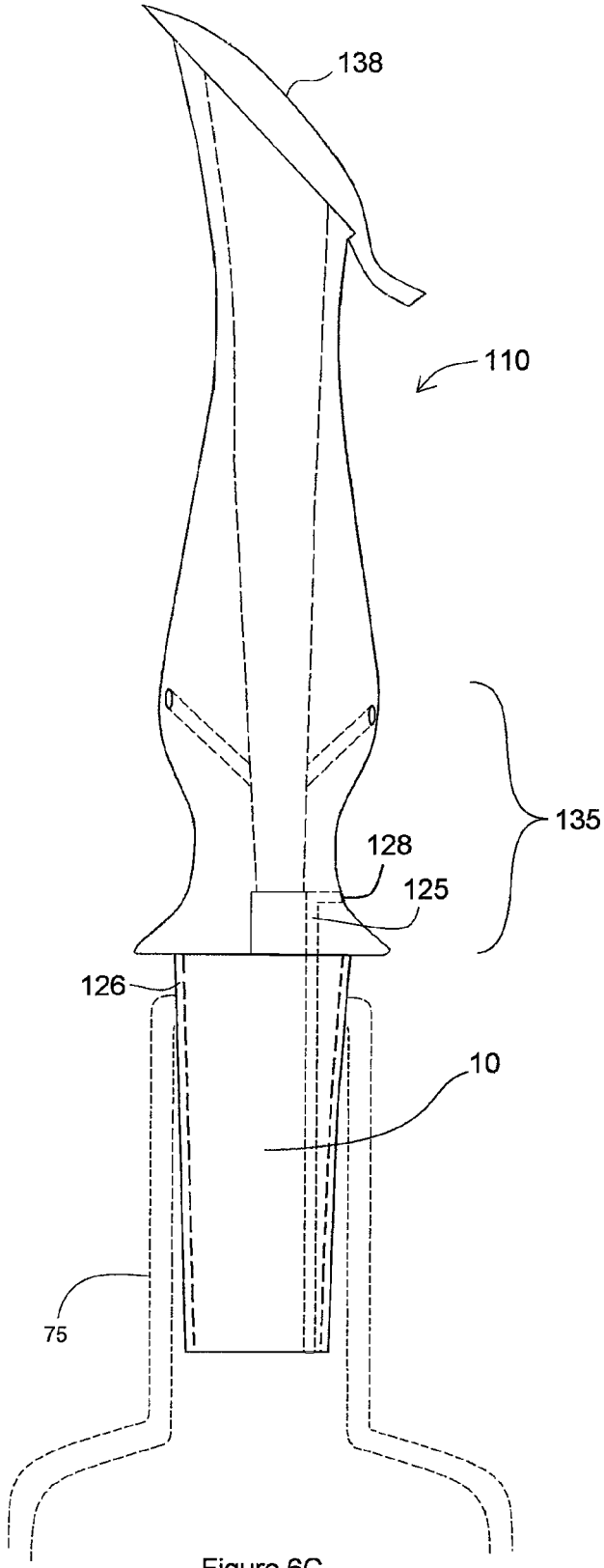
FIG. 6C is a side view of yet another embodiment of FIG. 5.

Referring now to FIGS. 6A, 6B and 6C, the function of breather tube 125 is to facilitate flow of the liquid from the bottle through pourer 200. The length and diameter of tube 125 controls the liquid flow rate which, in turn, affects the aeration of the liquid. In general, the rate increases as the length of breather tube 125 extends into the neck of the bottle.

With continuing reference to FIGS. 1 and 6A-6C, the diameter of breather tube 125 and lateral tubes 40 should be selected to avoid backwash and leakage therefrom while the liquid is poured through pourer 100 or 200, particularly as pouring first begins or is ending. Typically, for a pourer having an overall length of approximately 185 mm, the breather tube will have a length of approximately 80 mm, where entry section 10 is approximately 40 mm in length. The diameter of entry section 10 tapers from a maximum of approximately 23 mm, to a minimum of approximately 17 mm for insertion into a typical wine bottle opening.

The foregoing exemplary embodiments are described as having two diametrically opposed lateral tubes at their intersection with cylinder 20. For example, since the pourer of the present invention relies entirely on earth's gravitational force to initiate flow of the liquid through it, preferably one or more of lateral tubes 40 should not be located at or near the underside of the liquid channel flow through pourer 100. Rather, they should be located along the sides of the flow, preferably at a substantially acute angle 47 degrees relative to both the central axis 110 and to orthogonal axis 112.

It is also recognized that the device is operative with one or more lateral tubes. Moreover, the lateral tubes need not be symmetrically arranged, but may be positioned in a variety of ways, as desired for aesthetic purposes or otherwise. Therefore, in alternative embodiments of the present invention (not shown), there are one or more lateral tubes, each oriented so as to form a substantially acute angle relative to the axes of the intermediate cylindrical section. The acute angles may or may not be substantially the same.

Additionally, while the preferred embodiment of the present invention is described with respect to the introduction of air into wine, the device may be utilized to facilitate introduction of any fluid into another fluid, the fluids being liquid or gaseous. The preferred embodiment is contemplated to function at ambient pressures; however, the device may also be operated under pressure. Moreover, it is possible to utilize the multiple lateral tubes of the present invention to introduce multiple fluids into a single fluid flowing in the device.

The device is preferably composed of a transparent plastic material such as an engineered thermoplastic material, which yields a robust structure while allowing one to view the liquid as it is poured through the device. However, the device is readily fabricated using other materials that are known in the art, such as glass or metal.

In other alternative embodiments of the present invention (not shown), the entry section may have any shape that serves to funnel liquid towards the intermediate cylindrical section, such as an inverted pyramid-type shape. Likewise, the outflow section may be substituted for an alternative shape of generally increasing cross-sectional area from top to bottom, such as horn-shaped, tetrahedral or pyramidal.

Information as herein shown and described in detail is fully capable of attaining the above-described object of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, in which reference to an element in the singular is not intended to mean "one and only one" unless explicitly so stated, but rather "one or more."

All structural and functional equivalents to and combinations of the elements of the above-described preferred embodiment and additional embodiments that are known to those of ordinary skill in the art are hereby expressly incorporated by reference and are intended to be encompassed by the present claims. However, it should be readily apparent to those of ordinary skill in the art that various changes and modifications in form, apparatus material, and fabrication material detail may be made without departing from the spirit and scope of the invention as set forth in the appended claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. No claim herein is to be construed under the provisions of 35 U.S.C. §112, sixth paragraph, unless the element is expressly recited using the phrase "means for."

INDUSTRIAL APPLICABILITY

The present invention applies devices for incorporation of air into a liquid, such as wine, as it is poured from a bottle.

What is claimed is:

1. A venturi apparatus for incorporating into a liquid, said apparatus having:

a. a first section for channeling a liquid;

b. a conical shaped second section having an entry end and an outflow end, where the entry end is narrower in internal circumference than the outflow end, comprising a constricted tube;

c. a breather tube, with one end coupled to a ventilation port located along the second section and in fluid communication with ambient air, and the other end opening at the first section; and d. at least one lateral tube, each lateral tube:

i. comprising a first end emanating from the constricted tube;

ii. a second end open to the exterior apparatus; and iii. angled downstream with an acute angle relative to the outflow end for introducing ambient air.

2. The apparatus of claim 1, wherein the outflow end includes an outlet cover for covering the outflow end when the apparatus is not in use.

3. The apparatus of claim 1, wherein the entry end includes a tapered portion having a liquid seal coating for fitting into the mouth of a bottle and forming a liquid seal therewith.

* * * * *